US005232380A

United States Patent [19]

Inoue et al.

[11] Patent Number: 5,232,380

[45] Date of Patent: Aug. 3, 1993

[54] SHIELD COVER FOR ELECTRIC CONNECTOR

[75] Inventors: Nori Inoue; Soji Kihira; Fumiyoshi Tanigawa; Masahide Hio, all of Yokkaichi, Japan

[73] Assignee: Sumitomo Wiring Systems, Ltd., Mie, Japan

[21] Appl. No.: 923,451

[22] Filed: Aug. 3, 1992

[30] Foreign Application Priority Data

Sep. 7, 1991 [JP] Japan ..... 3-071855[U]

[51] Int. Cl.[5] ..... H01R 9/03

[52] U.S. Cl. ..... 439/610; 439/585

[58] Field of Search ..... 439/607-610, 439/98, 101, 108, 585

[56] References Cited

U.S. PATENT DOCUMENTS 3,958,851 5/1976 Evans ..... 439/609
4,269,469 5/1981 Audic ..... 339/177 R
4,337,989 7/1982 Asick et al. ..... 339/143 R
4,929,195 5/1990 Seidoh ..... 439/610
4,981,447 1/1991 Ichitsubo ..... 439/610
5,017,156 5/1991 Sugiyama ..... 439/607
5,055,063 10/1991 Sato ..... 439/607

*Primary Examiner*—Larry I. Schwartz
*Assistant Examiner*—Hien D. Vu
*Attorney, Agent, or Firm*—Sughrue, Mion, Zinn, Macpeak & Seas

[57] ABSTRACT

A pair of blade portions are provided in a shield cover, and an opening portion for a terminal insertion use is provided between the blade portions. After a connector housing is inserted through the opening portion, the blade portions are bent so as to close the opening portion, whereby the shielding property is prevented from being lowered by the existence of the opening portion into which a connector housing for connection with a shielded electric wire is inserted in an integral type of shield cover.

3 Claims, 5 Drawing Sheets

SHIELD COVER FOR ELECTRIC CONNECTOR

BACKGROUND OF THE INVENTION

The present invention generally relates to a shield cover, and more particularly, to an integrated type of metallic shell which is adapted to almost completely surround, flex a connecting portion between a shielding wire and a connector including a non-shielding district between a pressure fixing terminal portion and a shield processing portion so as to effect the shielding operation.

Recently, shielding wires are often used, as internal wiring for electric or electronic appliances, so as to remove influences of high frequency pulses, electromagnetic waves and vibrations. In motorcars where, for example, engine controls and so on are effected by computers called ECUs, signals from each type of sensor are fed to the ECU, each type of control of engine controls and so on are adapted to be effected in accordance with these signals. Wirings for connecting with the ECU often extend through the engine room and are subject to influences of engine vibrations, high frequency pulses and so on in the extension of the wirings through the engine rooms. In order to remove the influences, shielding wires are used.

As shown in FIG. 8, the periphery of a core 3 (hereinafter referred to as electric wire 3) with a core wire 1 being coated with an outer cover 2 is surrounded with a shield 4 which is a braided member of soft copper wires. The periphery of the shield 4 is coated with a housing 5 for insulation.

When a shielding wire 10 with many electric wires 3 being collected is used as a wire harness for motorcar use, the housing 5 is removed at its tip end by a given size as shown in FIG. 8 when the above-described shielding wire is connected with a connector. The shield 4 exposed in the housing removing portion is untied and intertwisted so as to form a connecting portion 6. Respective electric wires 3 are branched. The tip end of each electric wire 3 is also removed in outer cover 2 so as to expose the core wire 1. As shown in FIG. 9, a pressed terminal 7 is mounted to the core wire 1. The pressure fixing terminal 7 is inserted into each terminal accommodating chamber 82 of the connector housing 8 and is connected with the other party connector (not shown).

In the above-described connector connecting portion, the shield 4 is removed across the wide range from the terminal so as to branch the electric wire 3. In the pressure fixing portion with respect to the pressure fixing terminal 7, the core wire is exposed, so that the non-shielding district is wide, where the shield effect is almost equal to nothing.

Conventionally, the connector housing is surrounded with a metallic shell which is bent so as to effect the shielding operation. A connecting portion 8 composed of the above-described shield 4 is connected with the metallic shield so as to effect the shield processing operation.

A division type composed of a pair of metal shells 9 - I, 9 - II as shown in FIG. 9 and an integrated type composed of one metallic shell 9 as shown in FIG. 10 and FIG. 11 are provided as a shield cover composed of the above described metallic shield.

When the above described division type of shield cover is used, the connector housing 8 is covered, and the portion of the branched electric wire 3 which is not shielded by the shield 4 and which extends externally from the connector housing 8 can be completely covered, thus improving the shield effect.

But a pair of metallic shells made of two members are required, and they are required to be connected with each other, increasing the number of the parts, and the number of the assembling steps, with a problem of higher cost.

When the above described integrated type of shield cover is used, an opening portion is required rearwardly on the electric wire insertion side so as to insert it with ease in a case where a connector housing, into which the pressure fixing terminal of each electric wire tip end of the shielding wire is inserted, is set into the interior of the shield cover. A terminal 7 fixed under pressure to each electric wire 3 may be inserted into the terminal inserting chamber of the connector housing 8 set in advance into the shield cover interior. In this case, it cannot be inserted without the above-described opening portion. Therefore, the range of (A) in FIG. 11 cannot be shielded.

The shield cover composed of the conventional integrated type of metallic shell 9 has the front portion in the form of a bell portion 9*a* which surrounds the whole front outer peripheral portion of the connector housing 8 to be connected with the other party connector, and the rear portion including the top face with the opening portion 9*b*.

In the above described integrated type shield cover, there are advantages in that the engagement bother which is necessary in the division type can be omitted or the like. Since the connector housing or an opening portion 9*b* for terminal insertion use has to be provided in the shield cover, the shielding wire has an exposed portion which has an extremely large range in the terminal because of the existence of the opening portion 9*b*, with a disadvantage in that the shielding effect which is an original object is reduced in half.

SUMMARY OF THE INVENTION

Accordingly, the present invention is adapted to remove the above described disadvantages. An essential object of the present invention is to provide an improved shield cover for an electric connector, whereby in the shield cover composed of a metallic shell, an opening portion is provided so as to make it easier to effect an inserting operation of the connector housing, and to remove the opening portion after the assembling operation for a shielding effect.

Another important object of the present invention is to provide a shield cover for an electric connector, whereby as described hereinabove, a cover portion is provided for surrounding, flexing the connector housing and branch electric portion in the shield cover. Also, a shield processing barrel portion, for being fixed under pressure to the shield of the shielding wire and the outer cover, is provided so that the fixing under pressure with respect to the shielding wire by the barrel portion and the complete surrounding, flexing operation by the above-described cover portion may be effected at the same time so as to simplify the assembling operation.

In accomplishing these and other objects, according to one preferred embodiment of the present invention, the shield cover in accordance with the present invention is formed through press molding from a metallic piece. A housing engagement portion for surrounding, flexing the connector housing is provided in the front portion of the basic plate portion, and also, a pair of blade portions for projecting from both the sides of the width direction of the basic plate portion are provided in the rear portion of the housing engagement portion. An opening portion among the blade portions is provided and also, these blade portions are bent into a shape capable of closing the above-described opened portion after the connector housing, into which the pressure fixing terminal is inserted, is engaged through the above-described opening portion or after the pressure fixing terminal, which is connected with the connector housing where the shield cover is set in advance, is inserted.

A pair of barrel portions, for fixing under pressure to the shield and outer cover of the shielding wire, is provided in the rear portion of the above-described blade portion, and the barrel portion has triangular teeth interlocked to each other so that a pressure fixing operation with respect to the shielding wire by the barrel portion and the closing operation of the above-described opening portion are adapted to be effected at the same time by the press operation so as to simplify the shield processing operation with extreme ease.

A bending line composed of a minute slit or a thin portion is desired to be provided so that the above-described blade portion may be correctly bent.

As described hereinabove, in the shield cover of the present invention, an opening portion is formed at the time of insertion of the cover housing, and a pair of blade portions, for forming a closed portion closed by the bending operation after the insertion, are provided so that a problem of lowering the shielding property by the existence of the opening portion for the inserting operation of the connector housing or the terminal is avoided.

Also, as an integrated type, the number of parts and the number of engaging steps can be reduced.

BRIEF DESCRIPTION OF THE DRAWINGS

These and other objects and features of the present invention will become apparent from the following description taken in conjunction with the preferred embodiment thereof with reference to the accompanying drawings, in which.

DETAILED DESCRIPTION OF THE INVENTION

Figure 1:
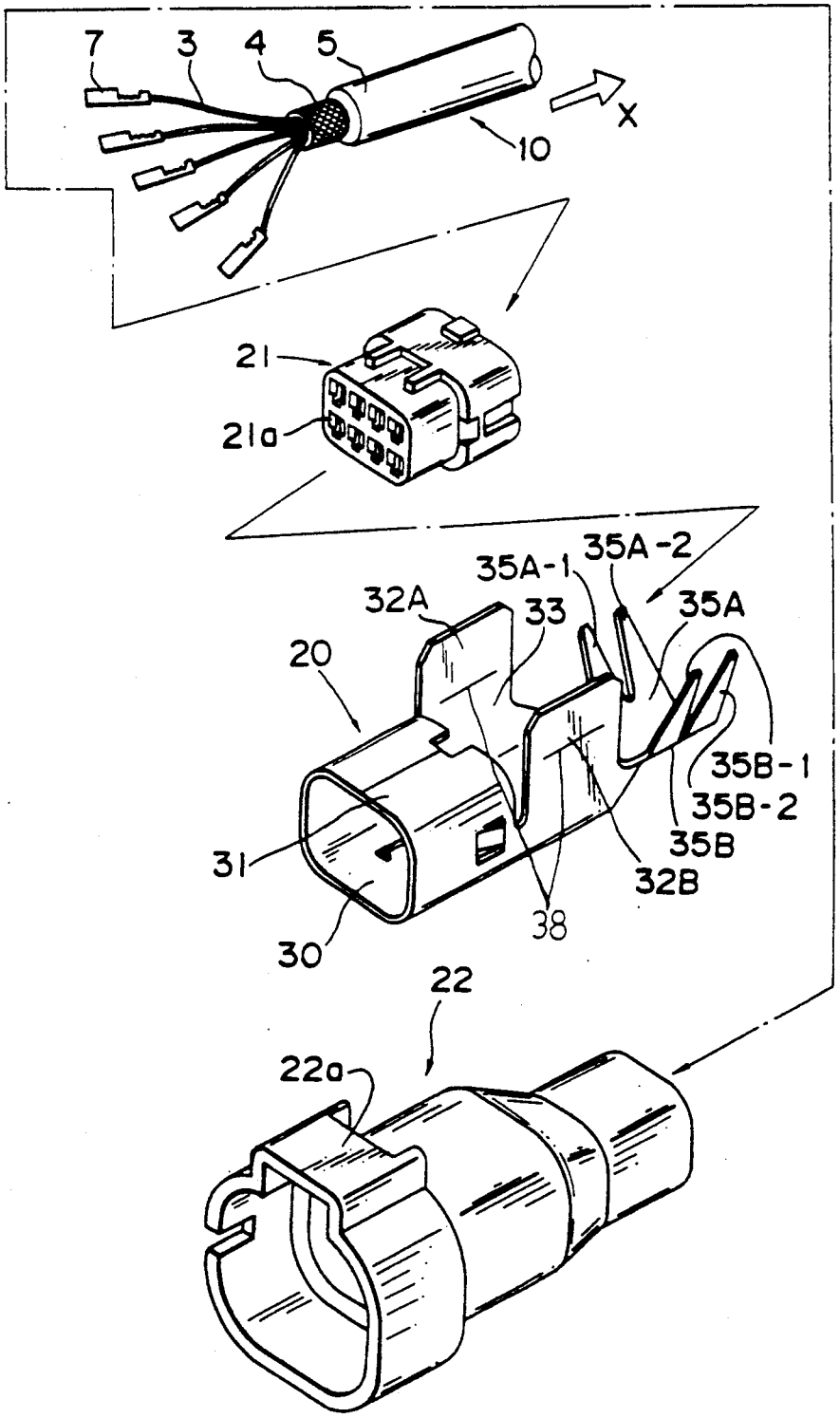
FIG. 1 is an exploded perspective view of a connector member using the shield cover in accordance with the present invention.

Before the description of the present invention proceeds, it is to be noted that like parts are designated by like reference numerals throughout the accompanying drawings.

Referring now to the drawings, there is shown in FIG. 1, a shield cover for an electric connector according to one preferred embodiment of the present invention, which includes a shield cover 20, a connector housing 21, and a protective cover 22 made of insulating resin for further covering the shield cover 20.

Figure 8:
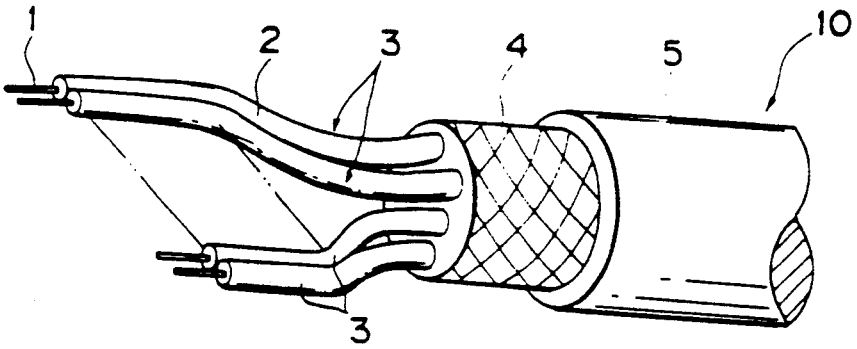
Fig. 8 PRIOR ART
FIG. 8 is a perspective view showing the shielding wire.
Figure 9:
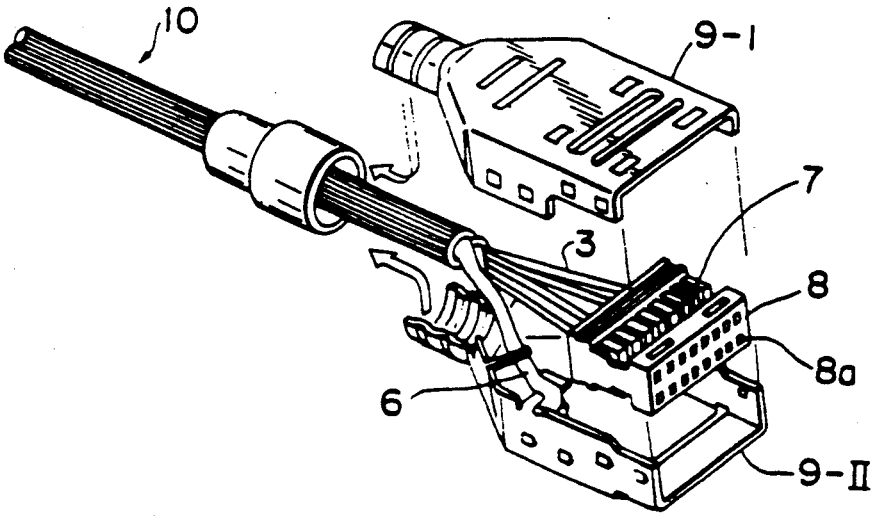
Fig. 9 PRIOR ART
FIG. 9 is a perspective view showing the shield cover of the conventional separate type of shield cover.
Figure 10:
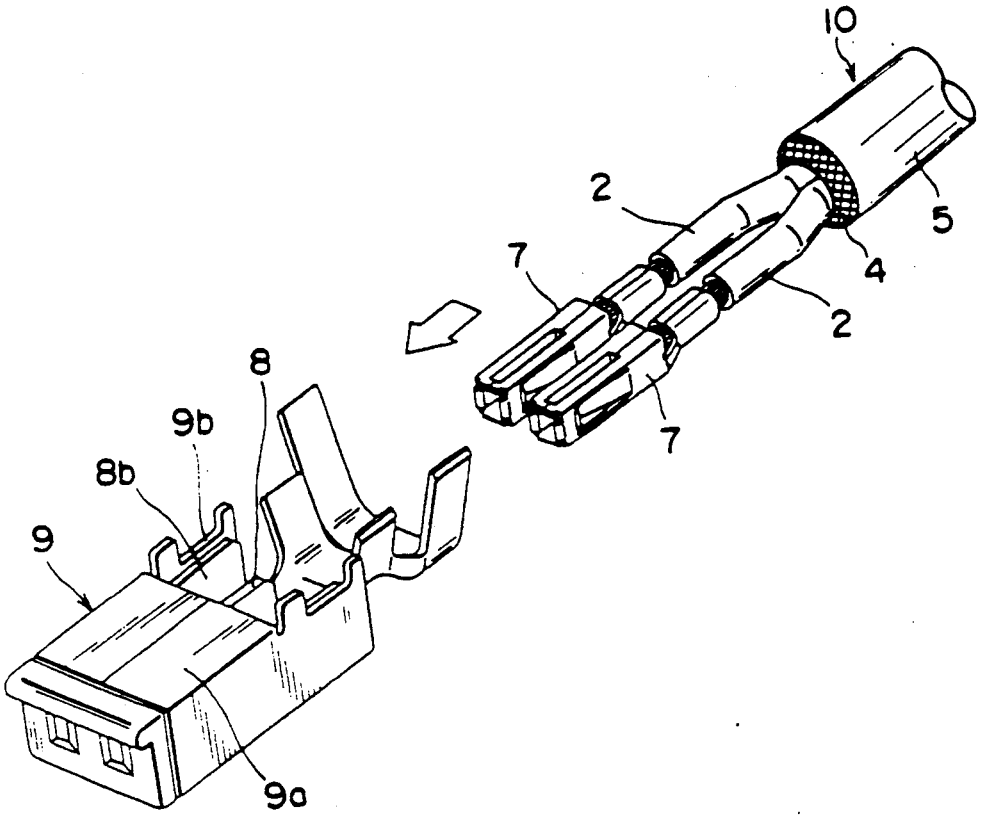
Fig. 10 PRIOR ART
FIG. 10 is a perspective view showing the shield cover of the conventional integrated type of shield cover.
Figure 11:
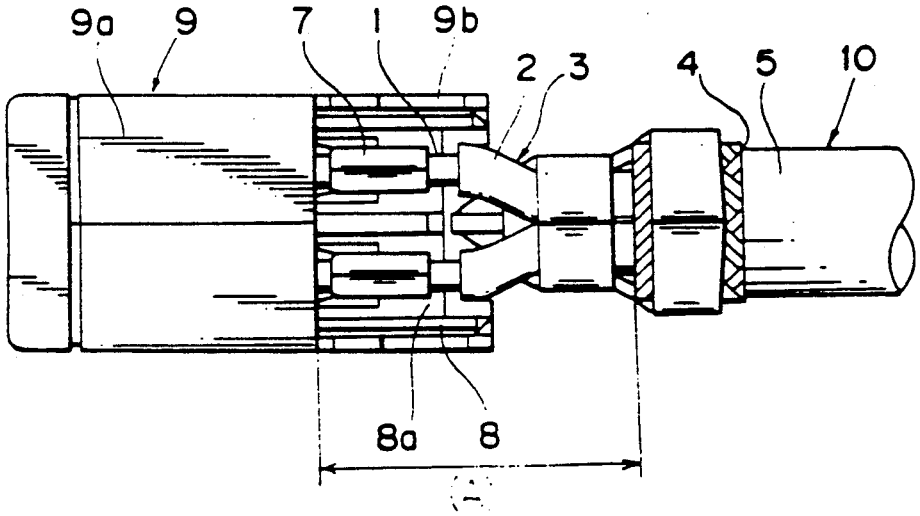
Fig. 11 PRIOR ART
FIG. 11 is a plan view of FIG. 10.

The shielding wire 10 is similar in construction as that shown in the above-described FIG. 8. The shielding wire 10 is extended through the above-described protective cover 22. Thereafter, the outer cover 5 and shield 4 of the tip end are removed respectively to the required amount so as to branch each electric wire 3. A pressure fixing terminal 7 is fixed under pressure to the tip end of each of the branched electric wires 3. The pressure fixing terminals 7, which are respectively connected with each electric wire 3 of the shielding wire 10 which has been inserted into the above-described protective cover 22, are inserted into the respective terminal accommodating chambers 21*a* of the connector housing 21 for a connecting operation. The connector housing 21, into which each of the pressure fixing terminals 7 is inserted, is adapted to be engaged into a shield cover 20.

The above-described shield cover 20 is shaped as shown with a metallic piece being provided as a press mold. A housing engaging portion 31 is formed in a square cylindrical or tubular shape with both the sides in the width direction of the front portion of the basic plate portion 30 being bent. A pair of blade portions 32A, 32B, which project upwardly from both the sides in the width direction of the basic plate 30, are provided in the central portion which continues into the housing engaging portion 31. The pair of blade portions 32A, 32B constitute a top face opening portion 33 between them as shown in FIG. 1. The upper half portions of the blade portions are bent into a mutually approaching direction after the terminal engagement. The upper half portions are formed with a predetermined size so as to constitute a generally square cylindrical portion 34 when bent which is similar in shape to the housing engaging portion 31, as shown in FIG. 2.

A bending line composed of a minute slit 38 is respectively provided in advance in the above-described blade portions 32A, 32B to ensure that the bending operation is effected in the given position at the time of bending. These slits 38 are set so that a vacant space is not formed between the opposite edges of the blade portions 32A, 32B when the bending operation has been effected.

A pair of barrel portions 35A, 35B, which project upwardly from both the sides in the width direction of the basic plate 30, are provided in the rear portions of the above-described blade portions 32A, 32B.

Figure 2:
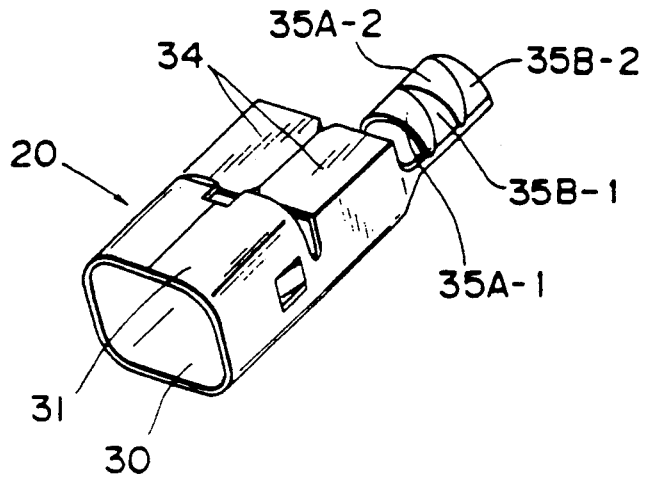
FIG. 2 is a perspective view showing the condition of the shield cover shown in FIG. 1 when in use.

These barrel portions 35A, 35B have such triangular tooth portions 35A - 1, 35A - 2, 35B - 1, 35B - 2 as to be interlocked with respect to each other continuously in the lengthwise direction, respectively (see FIG. 2).

The connector housing 21, into which the terminal 7 connected to each electric wire 3 of the shielding wire 10 has been inserted, is inserted into the shield cover 20 in a condition where the opening portion 33 is provided by virtue of the blade portions 32A, 32B being opened, as shown in FIG. 1, with the shield cover 20 being provided in the above-described shape.

Since the opening portion 33 is initially provided on the top face of the shield cover 20, the inserting operation of the connector housing 21 can be performed with ease.

After the connection of the above-described connector housing 21 has been completed, the opening portion 33 is closed, and a pressing operation for connecting the barrel portions 35A, 35B with the shielding wire 10 is effected at the same time.

The upper half portions of the blade portions 32A, 32B are bent onto the inner side as shown in FIG. 2 along the respective slits 38 and the tip end portions to be spliced are further turned down (see FIG. 3) so as to form the portion 34 in a square cylindrical shape (in section) which is almost completely closed.

Figure 3:
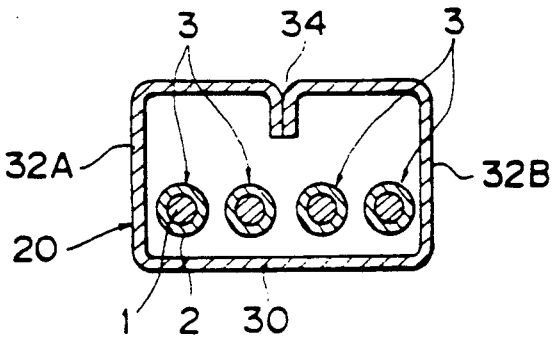
FIG. 3 is a sectional view showing a condition where the branched electric wire of the connector connecting portion is surrounded, flexed with the above-described shield cover.

As shown in FIG. 3, the portion of the electric wire 3, which is branched from the shielding wire 10 with the shield 4 being removed, is positioned within the above-described portion 34. Thus, while the shielding effect is not provided by the shield 4 since it has been removed, the shielding effect is provided through the closure by the shield cover 20.

Figure 4:
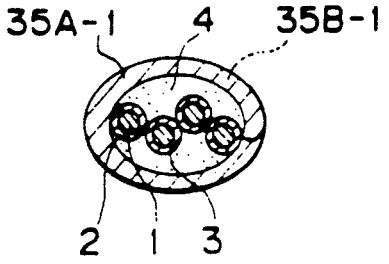
FIG. 4 is a sectional view showing a condition where the above-described shield cover is fixed under pressure with the shielding wire.

The bending-pressing operation, for fixing under pressure the barrel portions 35A, 35B to the shielding wire 4 and the outer cover 5 of the shielded wire 10, is effected at the same time with the pressing operation of the above-described blade portions 32A, 32B. The triangular tooth portions of the blade portions 32A, 32B are interlocked with each other by the bending operation of the barrel portion. As shown in FIG. 4, the triangular tooth portions 35A - 1, 35B - 1 on the front portion side are fixed under pressure to the shield 4. The triangular tooth portions 35A - 2, 35B - 2 on the rear portion side are fixed under pressure to the outer cover 5.

As described hereinabove, after the opening portion closure of the shield cover 20 and the pressure fixing with respect to the shielding wire of the barrel portion have been completed, the shielding wire 10 is slid in a direction shown with an arrow marked X in FIG. 1. The shield cover 20 having fixed therein the connector housing 21, which is engaged with the tip end of the shielding wire 10, is then set within the protective cover 22.

Figure 5:
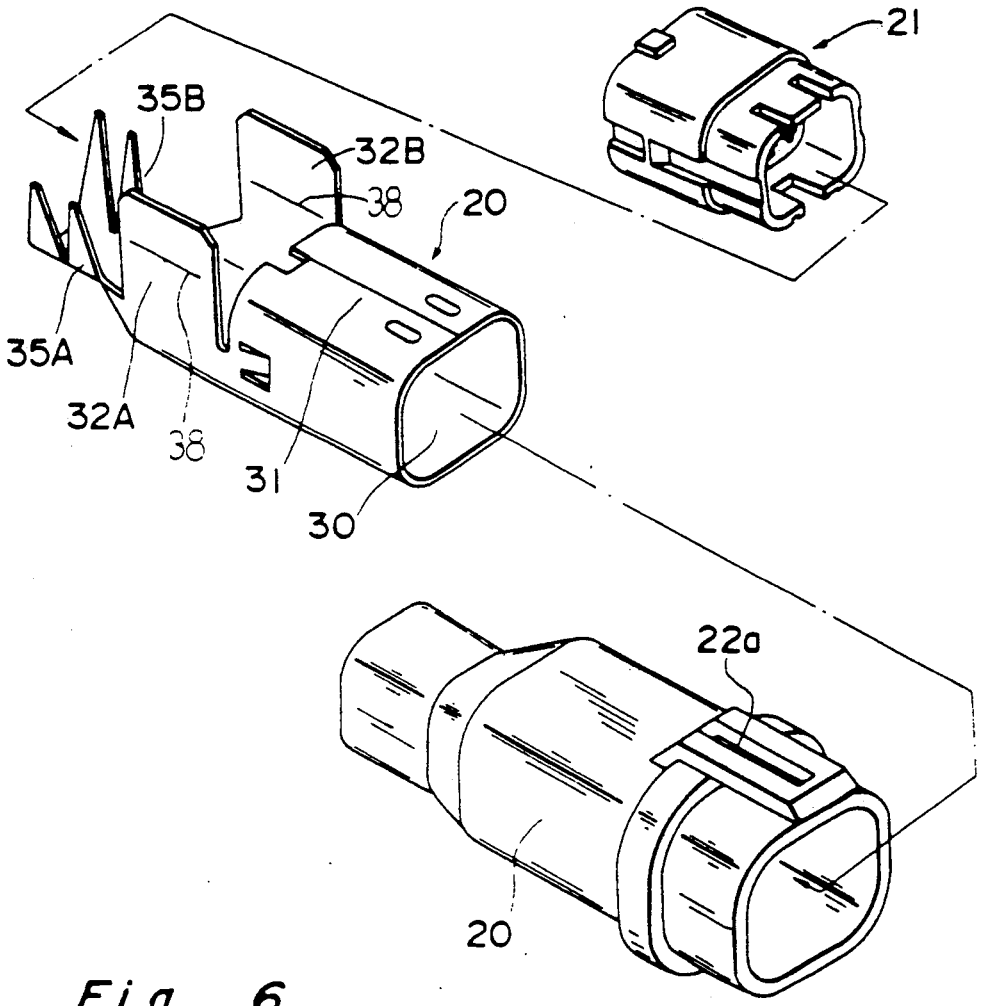
FIG. 5 is an exploded perspective view of the other party connector connecting with a connector shown in FIG. 1.

FIG. 5 shows the other party connector to be connected with the connecting side shown in FIG. 1. The other party connector also has a shield cover provided as shown in FIG. 1. As the shield cover, the connector housing and the protective cover in FIG. 5 are similar to those in FIG. 1, the description is omitted with like parts being designated by like reference numerals.

These mutually connected connectors are connected together with a lock portion **22*a* provided on the outer face of the protective cover 22** after completion of the respective engagement so as to effect a locking operation.

The shield cover of the present invention is not restricted to the above-described embodiment. An opening portion is formed at the time of insertion of the connector housing, and the shape of the blade portion to be closed by the pressing mold may be modified.

Figure 6:
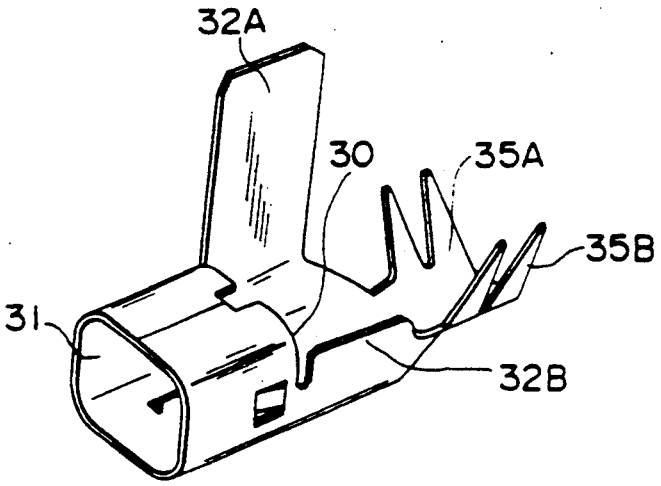
FIG. 6 is a perspective view showing a modified embodiment of the shield cover.

For example, as shown in FIG. 6, one blade portion 32A is made longer. The other blade portion 32B is made shorter. After the long blade portion 32A has been bent inwardly in the horizontal direction, it is bent downwardly towards the basic plate side so that the closed angular cylindrical portion may be formed with respect to the shorter blade portion 32B.

Figure 7:
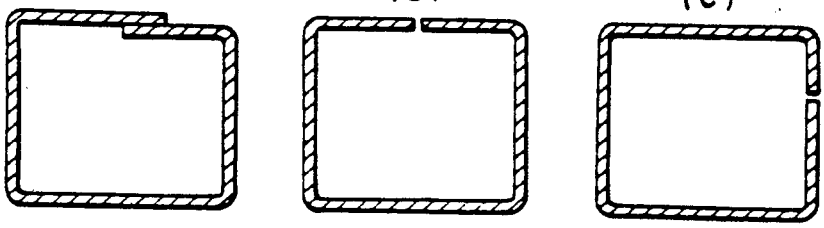
FIGS. 7(*a*), 7(*b*), 7(*c*) are schematic sectional views showing modified embodiments of the blade portion of the shield cover.

Further, blade portions 32A, 32B may be formed as shown in FIGS. 7(*a*), 7(*b*), 7(*c*). The shape of the blade portion is not restricted if the press molding can be effected in the cylindrical portion for closing the opening portion by lapping of the tip ends of a pair of blade portions in the center of the top face as shown in FIG. 7(*a*), butting thereof as shown in FIG. 7(*b*) or shaping thereof into a single blade shape as shown in FIG. 7(*c*) after the engagement of the connector housing to the shield cover.

Although a bending line composed of a slit is provided in the blade portion, a thin bending line which is changed into a slit and is made thin may be provided. The bending line does not necessarily need to be provided.

As is clear from the foregoing description, according to the shield cover of the present invention, the inserting operation can be effected with ease as the opening portion is provided at the time of insertion of the connector housing. Since the opening portion is closed after completion of the insertion operation, the shielding operation of the connector connecting portion which is exposed can be effected. The reduction of the shielding effect in the connector connecting portion can be reduced.

As the shield cover of the present invention is composed of one metallic shell, the number of parts and the number of engaging steps are reduced as compared with a case where they are provided as separate members, so that the cost can be reduced.

The barrel portion, for being fixed under pressure to the shield and the outer cover of the shielding wire, is formed integrally together with a cover portion for surrounding, flexing the connector housing and the exposed portion of the electric wire. As the pressure fixing operation of the barrel portion can be effected by the pressing operation simultaneously with the closing operation of the above-described opening portion, the shielding operation can be effected with ease. Especially, as compared with a case where the shield of a portion with the outer cover being peeled off from it is unfastened so as to form the connecting wires, an operationality can be considerably improved as compared with a case where the connecting wires are connected with the shield cover.

Further, as the above-described barrel portion is fixed under pressure with the triangular tooth portions which are interlocked with each other, the pressure fixture retaining force can be made larger if the fastening force is not increased so much, with an advantage that the pressure fixing operation with respect to the shield is superior.

Although the present invention has been fully described by way of example with reference to the accompanying drawings, it is to be noted here that various changes and modifications will be apparent to those skilled in the art. Therefore, unless otherwise such changes and modifications depart from the scope of the present invention, they should be construed as included therein.

What is claimed is:

1. A shield cover for an electrical connector, the electrical connector including a connector housing having at least one pressure fixing terminal accommodated therein, the at least one pressure fixing terminal being fixed under pressure to a tip end of a corresponding electric wire protruding from a shielded wire, the shielded wire including an inner shield and an outer cover, said shield cover comprising:

a) a basic plate portion having a front portion and a rear portion;

b) a tubular housing engagement portion provided in the front portion of said basic plate portion and which surrounds and snugly fits over the connector housing; and c) a pair of blade portions projecting from said basic plate portion at diametrically opposed sides thereof, said blade portions being disposed behind said tubular housing engagement portion, said blade portions defining an opening portion therebetween through which the connector housing is inserted into said tubular housing engagement portion; wherein said blade portions are bent so as to close said opening portion after the connector housing is inserted through said opening portion and is positioned within said tubular housing engagement portion, thereby to cover and shield the electric wire which protrudes from the shielded wire.

2. The shield cover as defined in claim 4, further comprising a pair of barrel portions for being fixed under pressure to the inner shield and the outer cover of the shielded wire and provided at the rear portion of said basic plate portion and behind said blade portions, each of the barrel portions having triangular teeth interlocked to each other.

3. The shield cover as defined in claim 1, further comprising bending lines provided in said blade portions.

* * * * *